US008794324B2

(12) United States Patent
Vlasko

(10) Patent No.: US 8,794,324 B2
(45) Date of Patent: Aug. 5, 2014

(54) ONE TRIP TREATMENT SYSTEM WITH ZONAL ISOLATION

(75) Inventor: Brian Vlasko, Redondo Beach, CA (US)

(73) Assignee: Baker Hughes Incorporated, Houston, TX (US)

( * ) Notice: Subject to any disclaimer, the term of this patent is extended or adjusted under 35 U.S.C. 154(b) by 312 days.

(21) Appl. No.: 13/453,442

(22) Filed: Apr. 23, 2012

(65) Prior Publication Data

US 2013/0277051 A1 Oct. 24, 2013

(51) Int. Cl.
*E21B 43/04* (2006.01)
*E21B 33/13* (2006.01)

(52) U.S. Cl.
CPC ..... *E21B 33/13* (2013.01); *E21B 43/04* (2013.01)
USPC ..... 166/278; 166/51

(58) Field of Classification Search
USPC ..... 166/278, 285, 305, 305.1, 308.1, 51
See application file for complete search history.

(56) References Cited

U.S. PATENT DOCUMENTS 7,100,691 B2 * 9/2006 Nguyen et al. ..... 166/278
8,201,631 B2 * 6/2012 Stromquist et al. ..... 166/308.1
2002/0088621 A1 7/2002 Hamilton et al.
2007/0044962 A1 3/2007 Tibbles
2007/0284109 A1 12/2007 East et al.
2010/0155064 A1 6/2010 Nutley et al.
2011/0132596 A1 6/2011 Yeh et al.
2011/0203793 A1 8/2011 Tibbles

OTHER PUBLICATIONS

International Search Report and Written Opinion; International Application No. PCT/US2013/033507; Internation filing date: Mar. 22, 2013; Date of mailing: Jun. 26, 2013; 17 pages.
Production Operations, [online]; [retrieved on Jun. 12, 2012]; retrieved from the Internet http://www.spe.org/jpt/print/archives/1998/03/98March_ProdOperations.pdf, L.G. Jones et al., "Shunts Help Gravel Pack Horizontal Wellbores With Leakoff Problems," Mar. 1998, pp. 68-69.

* cited by examiner

*Primary Examiner* — William P Neuder
(74) *Attorney, Agent, or Firm* — Cantor Colburn LLP

(57) ABSTRACT

A treatment system including a seal assembly operatively arranged with respect to a first zone in a borehole for isolating the first zone from a second zone and a third zone. The second and third zones are located on opposite sides of the first zone. A string assembly extends between the second zone and the third zone, forms a first fluid pathway operatively arranged to bypass the first zone and enable fluid communication between the second and third zones. The first fluid pathway is fluidly connected to an annulus of the borehole for enabling a treatment of the second and third zones to be performed simultaneously. A method of operating a treatment system is also included.

27 Claims, 4 Drawing Sheets

ONE TRIP TREATMENT SYSTEM WITH ZONAL ISOLATION

BACKGROUND

In the pursuit of hydrocarbons, operators of downhole systems encounter a variety of conditions in the downhole drilling and completions industry. One such condition is the presence of undesirable or less desirable zones, such as water bearing zones, gas bearing zones, etc. Inflow control devices and other tools have been devised to increase the efficiency of production, e.g., by reducing the water or gas content in the produced fluids. Although these devices work well for their intended uses, they are not without limitation, particularly in zones that are heavily unfavorable to production. While these zones can be isolated to prevent collapse, or contamination or dilution of neighboring zones, this also prevents fluid communication across the isolated zone and limits downhole activity without extensive intervention and multiple trips. A similar situation would be encountered with any isolated zone, even if production from the isolated zone is desired (e.g., the isolated zone is a frac interval surrounded by zones which are desired to be cemented), if all zones are desirable, (e.g., in a selective acidizing treatment or well stimulation), etc. The industry would well receive a single trip system for isolating a selected zone while permitting fluid communication thereacross for enabling two zones on opposite sides of the isolated zone to be simultaneously treated.

SUMMARY

A treatment system, including a seal assembly operatively arranged with respect to a first zone in a borehole for isolating the first zone from a second zone and a third zone, the second and third zones located on opposite sides of the first zone; and a string assembly extending between the second zone and the third zone, the string assembly forming a first fluid pathway operatively arranged to bypass the first zone and enable fluid communication between the second and third zones, the first fluid pathway fluidly connected to an annulus of the borehole for enabling a treatment of the second and third zones to be performed simultaneously.

A method of operating a downhole system, including isolating a first zone in a borehole from a second zone and a third zone located on opposite sides of first zone; and treating the second zone and the third zone simultaneously through one of a first flow pathway fluidly connected to an annulus of the borehole, the first flow pathway formed by a string assembly extending between the second zone and the third zone and operatively arranged to bypass the first zone while enabling fluid communication between the second and third zones.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
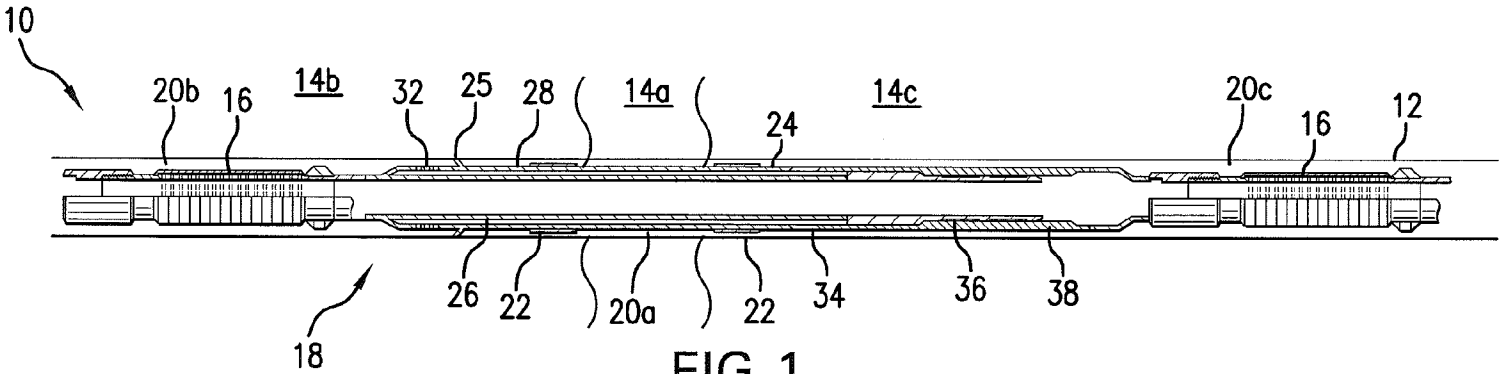
FIG. 1 is a quarter-sectional view of a zonal isolation system that provided fluid communication across the isolated zone.
Figure 2:
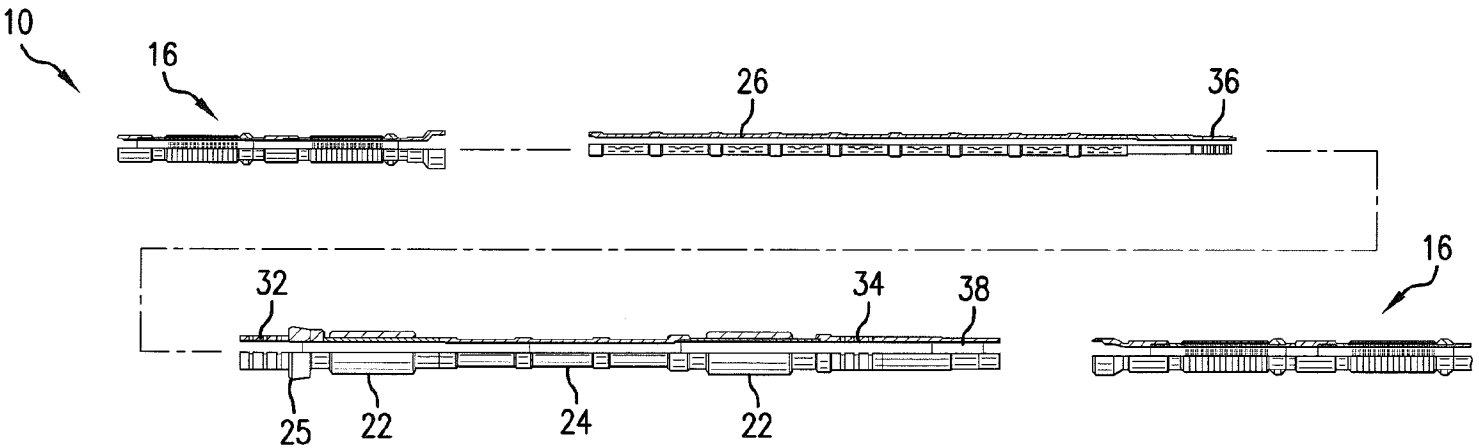
FIG. 2 is an exploded view of a zonal isolation system.

Referring now to FIGS. 1 and 2, a system 10 is illustrated for enabling zonal isolation in a borehole 12 while maintaining bi-directional fluid communication between opposite sides of the isolated zone, that is, fluid communication in both the downhole and up-hole directions. In the illustrated embodiment, a zone 14*a* is desired to be isolated from a pair of neighboring zones 14*b* and 14*c*. The zones 14*a-c* may also be referred to as intervals, sections, etc. In the embodiment illustrated in FIGS. 1 and 2, the system 10 enables production from the zones 14*a* and 14*b*, while fluid communication is maintained therebetween. For this purpose, the system 10 includes a screen assembly 16 arranged in each of the zones 14*b* and 14*c* with a string assembly 18 extending therebetween. In one embodiment, the screen assemblies 16 and the string assembly 18 are, e.g., part of a production string that enables fluids to flow from an annulus 20 of the borehole 12 into the production string. The screen assemblies 16 could be any known screen or filter, e.g., mesh wrapped screens, slotted liners, etc.

As described in more detail below, the string assembly 18 is additionally arranged to maintain fluid communication between the zones 14*b* and 14*c*, thereby enabling the zones 14*b* and 14*c* to be simultaneously treated. It is to be understood that the terms "treated", "treating", and "treatment" are to be defined broadly and relate to a variety of downhole operations in which some fluid, fluid-containing, fluid-based, or fluid-like media is pumped or delivered to the annulus 20, such as gravel packing, acidizing, chemical stimulation, cementing, etc. Thus, it is to be additionally understood that the term "fluid", e.g., as used in "fluid communication", is intended to be interpreted broadly to include not only gases and liquids, but also solids that are suspended or included in a flow of fluid, or solids or other media that are flowing, flowable, or generally exhibit fluid-like properties, such as a sand or gravel slurry utilized in gravel pack operations or the like. A seal or packer assembly 22 is provided to seal or isolate opposite sides of the zone 14*a* in order to seal the zone 14*a* from the other zones 14*b* and 14*c*. In embodiments in which fluids in the zones 14*b* and 14*c* are produced, for example, the zone 14*a* could be a water bearing zone, a shale zone, a gas bearing zone, a collapsed open hole section, or some other unwanted, undesired, inefficient, or unsatisfactory zone. The seal or packer assembly 22 could include any suitable seal or packer devices known in the art, including reactive element packers, inflatable packers, compressible packers, etc., and include any combination of various materials such as shape memory materials, elastomers, swellable materials, etc. In the illustrated embodiment the packer assembly 22 includes reactive element or swellable packers that passively actuate in response to contact with downhole fluids, although known assemblies for setting the packers 22, e.g., hydraulically, mechanically, pneumatically, electrically, magnetically, etc., could alternatively be utilized. Since reactive element packers generally take a significant amount of time to set, e.g., sometimes more than a day, a barrier 25 can be included in some embodiments to engage against the borehole 12 and provide isolation in the annulus 20 before the packers 22 are set. In this way, e.g., the barrier 25 enables the isolation necessary to generate fluid pressure in the borehole 12 for actuating tools in the borehole 12, e.g., setting other packers, opening valves, etc.

In order to provide bi-directional fluid flow or communication through the system 10, the string assembly 18 includes an outer string 24 and an inner string 26. A first fluid flow pathway 28 is defined between the outer string 24 and the inner string 26, while a second fluid flow pathway 30 is defined internally within the inner string 26. Access into and out of the pathway 28 is provided by a set of ports 32 and 34, which are both in fluid communication with the annulus 20. Each set of the ports 32 and 34 could include any number of ports or openings of any desired size and arranged in any desired pattern circumferentially about all or a portion of the outer string 24.

The port 32 is in fluid communication with a section 20*b* of the annulus 20 proximate to the zone 14*b* while the port 34 is in fluid communication with a section 20*c* the annulus 20 proximate to the zone 14*c* in order to provide fluid communication between the sections 20*b* and 20*c* while bypassing a section 20*a* of the annulus proximate to the isolated zone 14*a*. In this way, for example, a gravel pack slurry or other fluid, fluid-based, or fluid-like mixture can be communicated downhole while maintaining isolation of the undesired zone 14*a*. One of ordinary skill in the art will recognize that in order to perform a gravel pack operation, a tail pipe or similar tubular (not illustrated) would be inserted through the inner string 26 for directing the fluid of the slurry back to surface, i.e., according to known gravel pack methods. The fluid pathway 30 is in fluid communication with the annulus 20 via the screen assemblies 16 and can, e.g., be used for the production of downhole fluids to surface. It is to be appreciated that the bi-directional fluid communication could be used for purposes or operations other than production and gravel packing, e.g., circulation, downhole tool control or actuation, formation treatments, etc.

It is to be appreciated that while two desirable zones, i.e., the zones 14*b* and 14*c*, are illustrated, that the system 10 is usable in any situation in which it is desired to bypass a zone to communication with another zone further downhole. In other words, the screen assembly 16 in the zone 14*b* is not necessary. That is, for example, even if production is not occurring above the undesired zone 14*a*, isolating the zone 14*a* still facilitates the flow of fluid into the ports 32 and the pathway 26, and thus the communication of fluids downhole. Furthermore, any number of undesirable zones could be similarly isolated and bypassed along the length of the borehole 12.

Some aspects of the system 10 are illustrated in more detail in FIG. 2. For example, in the embodiment of FIG. 2, the outer string 24 is formed from multiple sections of blank pipe, while the inner string 26 is formed from multiple sections of slotted pipe. While blank pipe could be used for the inner string 26, slotted pipe can be used, for example, to promote the flow of gravel pack slurry downhole to ensure that the slurry is packed evenly and that voids do not form around the screen assemblies 16. Of course, one of ordinary skill in the art will recognize that the risk of sand bridging due to fluid leaking through the slots in the inner string 26 during gravel packing is minimized or eliminated by forming the slots with a flow area therethrough that is sufficiently less than that of the fluid pathway 28, by setting a sufficiently high flow rate of the gravel slurry through the pathway 28, etc. By varying the length or number of pipe sections used to form the inner and outer strings, undesirable zones of any size can be bypassed. FIG. 2 also illustrates two screen joints for each screen assembly 16 and it is accordingly to be appreciated that any number could be included above or below the isolated zone 14*a*.

Figure 3:
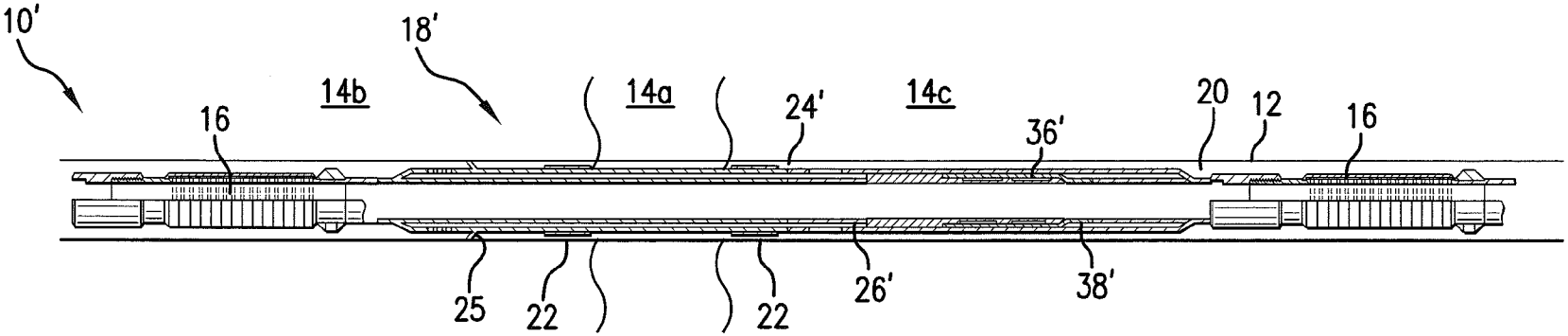
FIG. 3 is a quarter-sectional view of a fluid string assembly for a zonal isolation system according to one embodiment disclosed herein.
Figure 4:
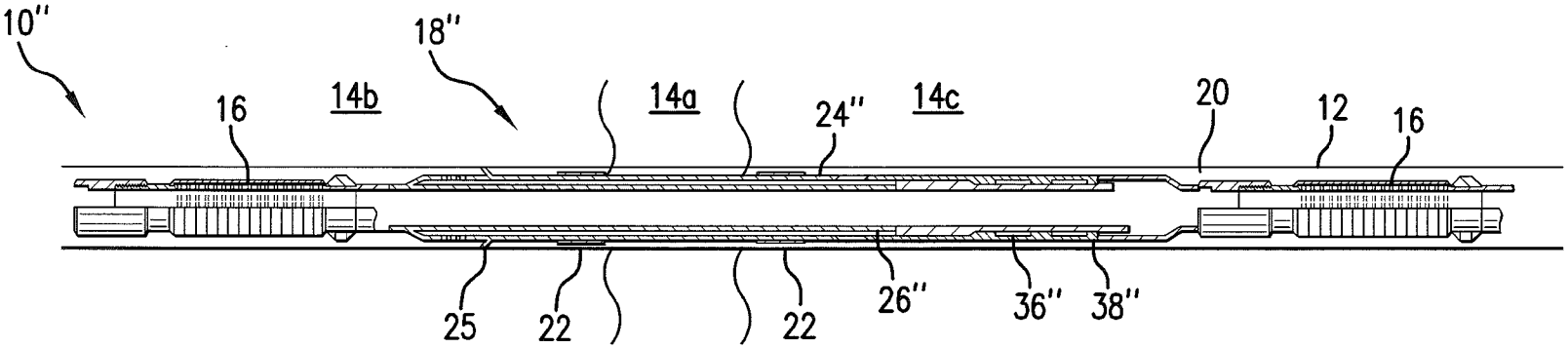
FIG. 4 is a quarter-sectional view of a fluid string assembly for a zonal isolation system according to another embodiment disclosed herein.

Other variations, modifications, and embodiments are also contemplated. For example, in FIGS. 1 and 2, the inner string 26 includes a set of one or more seals 36 that is received in a receptacle or seal bore 38 formed in the outer string 24. In FIG. 3, a modified string assembly 18' is partially shown, with an outer string 24' and an inner string 26'. Unlike the embodiment of FIGS. 1-2, a set of one or more seals 36' and a seal bore 38' are both included in or formed by the inner string 26'. In this embodiment, the outer string 24' could be welded or secured in another manner as a sheath or shroud about the inner string 26'. FIG. 4 discloses a so-called inverted seal embodiment for an alternate assembly 18" where an inner string 26" is a slick line and one or more seal elements 36" and a seal bore 38" are provided in the outer string 24". Advantageously, all of the above described assemblies are suitable for a one trip installation and, from the perspective of operators at surface, enable gravel packing to be performed essentially as normal. Of course, any other method of securing together the inner and outer strings for forming the two fluid pathways could be utilized and these are provided for illustration only. Additionally, it is to be recognized that while the inner and outer strings are illustrated as being concentrically arranged with a radial gap forming the fluid pathway 26 therebetween, the string assembly 18 could take other forms. For example, a single string could be bisected or divided into two fluid pathways by a longitudinally extending fluid barrier or wall (e.g. into a "left" side and a "right" side), the inner string could be eccentrically disposed within the outer string, longitudinally extending slots or channels in either the inner or the outer string could be used in lieu of a radial gap in order to reduce the radial dimension of the assembly 18, etc. Furthermore, any known actuatable or controllable valve, sleeve, etc. could be positioned at the ports 32 and/or 34 to selectively enable or disable fluid communication therethrough. As another example, a chemical additive could be applied to the outer string 24 in the area between the seal assemblies 22 in order to help plug or isolate the undesired zone 14*a*.

Figure 5:
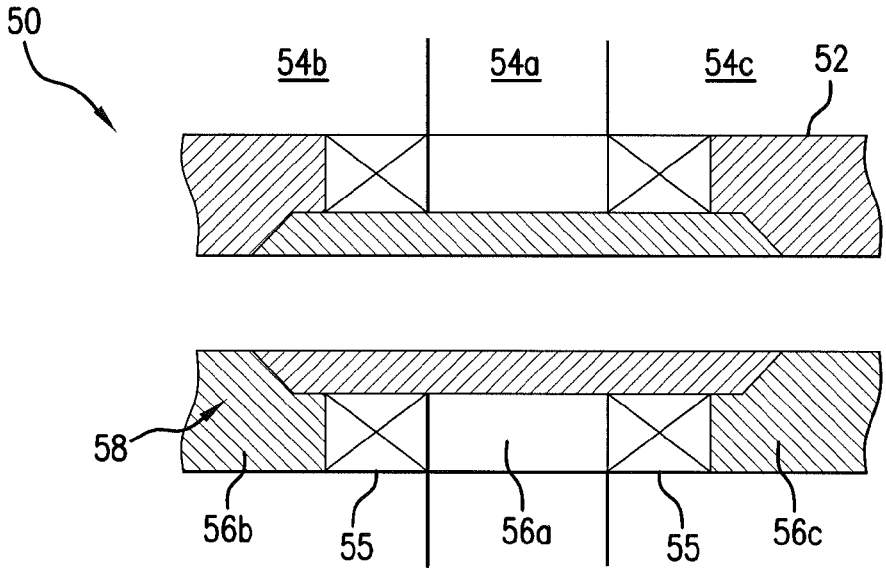
FIG. 5 schematically illustrates a system according to another embodiment disclosed herein.
Figure 7:
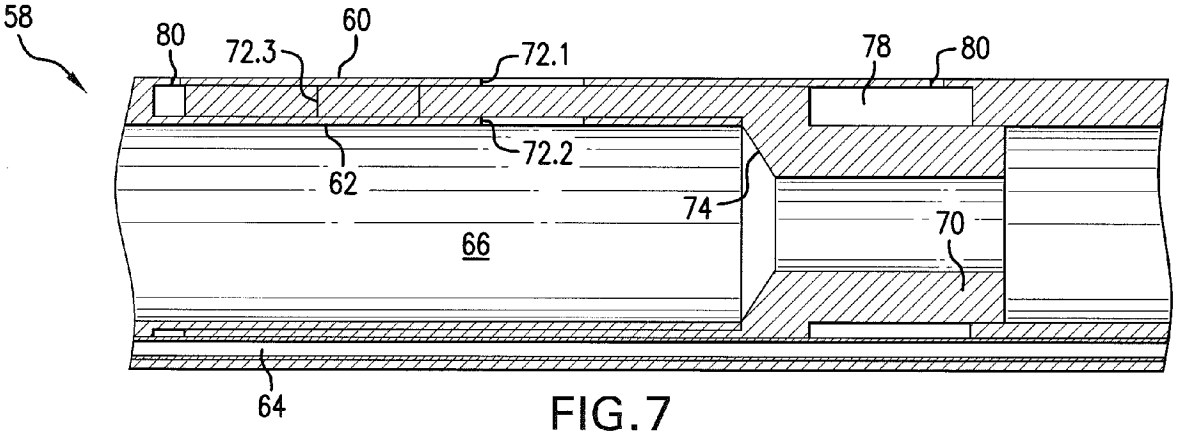
FIG. 7 is a cross-sectional view of the system of FIG. 6 taken generally along the line 7-7.
Figure 8:
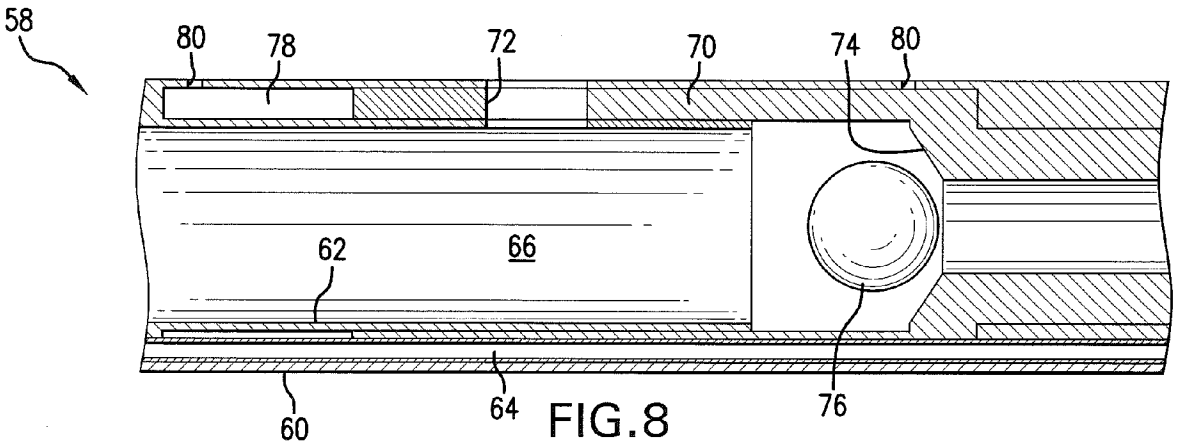
FIG. 8 is a cross-sectional view of the system of FIG. 7 having ports in an opened configuration.

A system 50 according to another embodiment is illustrated in FIG. 5. The system 50 is arranged in a borehole 52 particularly for enabling fracturing of and production through a zone 54*a* while enabling two zones 54*b* and 54*c* on opposite sides thereof to be simultaneously treated. The zone 54*a* is isolated from each of the zones 54*b* and 54*c* by a packer or seal assembly 55, similar to the packer or seal assembly 22. In the embodiment (discussed below in more detail with respect to FIGS. 6-8), the system 50 is arranged as part of or connected to a production string assembly in order to enable cementing of the zones 54*b* and 54*c* while the zone 54*a* is able to fractured and/or produced from. The system 50 does share some similarities with the system 10 because it is also arranged as a one-trip system that enables fluid communication between sections (e.g., designated 56*b* and 56*c*) of an annulus (e.g., an annulus 56 of the borehole 52) located on opposite sides of an isolated interval (e.g., the zone 54*a*), i.e., for simultaneously treating the two zones (e.g., the zones 54*b* and 54*c*) on opposite sides of the isolated zone.

Figure 6:
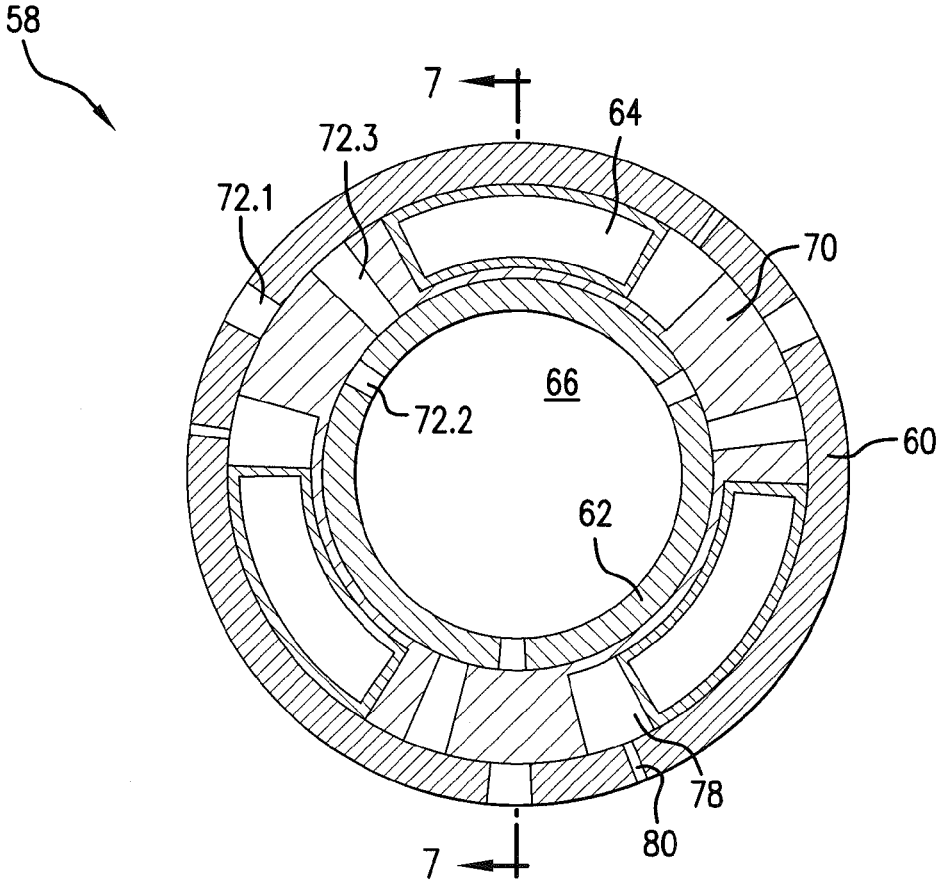
FIG. 6 is a cross-sectional view of the system of FIG. 5.

Specifically, the system 50 includes a string assembly 58 having an outer string 60 and an inner string 62 for forming a first fluid pathway 64 between the inner and outer strings 60 and 62 and a second fluid pathway 66 internal to the inner string 62. In the embodiment of FIG. 6, the first fluid pathway 64 is illustrated as being formed by three discrete pathway portions, although other embodiments could include any other number. Unlike the embodiment discussed above with respect to FIG. 1 in which the isolated zone 14*a* is an "undesired" zone (e.g., the zone 14*a* is a water or gas containing interval from which production is not desired), the isolated zone 54*a* in the embodiment of FIG. 5 can be understood to be a "desired" zone (e.g., the zone 54*a* is a frac interval from which production is desired). For this reason, the fluid pathways 64 and 66 defined by the string assembly 58 do not both extend between the same set of zones. Instead, the first pathway 64 (e.g., arranged for treatment such as cementing), is only in fluid communication with the zones 54*b* and 54*c*, while the second fluid pathway 66 (e.g., arranged for production and fracturing), is only in fluid communication with the isolated zone 54*a*. From the perspective of operators at surface, cementing or other well treatments would be performed essentially as normal according to known techniques. That is, cement or other fluid or media would be pumped or delivered into the section 56*b* of the annulus 56, and then routed around the zone 54*a* via the fluid pathway 64 and into the section 56*c* of the annulus 56. In this way, the zones 54*b* and 54*c*, similar to the zones 14*b* and 14*c*, can be simultaneously treated while maintaining isolation of the zone 54*a* located therebetween.

In order to enable fracturing of the zone 54*a* if such operation is desired, the system 50 includes a valve or sleeve mechanism 70 for selectively opening one or more ports 72 in fluid communication with a section 56*a* of the annulus proximate to the isolated zone 54*a*. In other words, the mechanism 70 selectively enables fluid communication between the annulus section 56*a* and the first fluid pathway 64. In the illustrated embodiment, the ports 72 are split into a plurality of sections designated 72.1, 72.2, and 72.3, located respectively in the outer string 60, the inner string 62, the mechanism 70.

By aligning each set of the sections 72.1, 72.2, and 72.3, the ports 72 are opened. For example, referring to FIGS. 7 and 8 the assembly 58 can be seen with the ports 72 in a closed configuration and an open configuration, respectively. By shifting or actuating the mechanism 70, the port sections can be aligned as noted above for opening the ports 72. The actuation of the mechanism 70 could be shifted mechanical, hydraulic, electrical, magnetic, etc. The sections of the port 72 could be alignable rotatably, axially, etc., or combinations thereof. For example, in the illustrated embodiment a combination of axial movement and rotation due to the axial movement aligns the sections of the ports 72. That is, the mechanism 70 includes a seat 74 for receiving a ball or plug 76, which block fluid flow through the seat 74 and enables fluid pressurization against the plug 76 and the seat 74 for shifting the mechanism 70 into the configuration shown in FIG. 8. In order to cause the rotation of the mechanism 70 in response to axial actuation, the mechanism may be complementarily slotted, grooved, profiled, surfaced, engaged, etc. with respect to one or both of the outer string 60 or the inner string 62 or a component thereof. In order to accommodate rotational and/or axial movement of the mechanism 70, a chamber 78 is included into which the mechanism can move. The chamber 78 could be an atmospheric chamber or include a suitable low pressure fluid and/or sufficient volume for compression of the fluid without interfering with actuation of the mechanism 70, or otherwise include an equalization port 80 to the annulus 56. As can be appreciated in view of FIGS. 6-8, the first fluid pathway 64 is separated from the mechanism 70 and does not interfere with the operation of the mechanism 70 or the ports 72 such that fracturing and production can be carried out by operators at surface essentially according to known methods. Likewise, the mechanism 70 and the ports 72 do not interfere with the fluid pathway 64 such that cementing or other treatment can be carried out by operators at surface essentially according to known methods.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A treatment system, comprising:

a seal assembly operatively arranged with respect to a first zone in a borehole for isolating the first zone from a second zone and a third zone, the second and third zones located on opposite sides of the first zone; and a string assembly extending between the second zone and the third zone, the string assembly forming a first fluid pathway operatively arranged to bypass the first zone and enable fluid communication between the second and third zones, the first fluid pathway fluidly connected to an annulus of the borehole for enabling a treatment of the second and third zones to be performed simultaneously.

2. The system of claim 1, wherein the string assembly forms a second fluid pathway in fluid communication with at least one of the first, second or third zones for enabling production of fluids therefrom.

3. The system of claim 2, wherein the string assembly includes an inner string and an outer string for forming the first and second fluid pathways.

4. The system of claim 3, wherein the first fluid pathway is defined between the inner string and the outer string, and the second fluid pathway is defined internally within the inner string.

5. The system of claim 1, wherein the treatment includes cementing, gravel packing, acidizing, stimulating, or a combination including at least one of the foregoing.

6. The system of claim 1, further comprising a first screen assembly connected to the string assembly in the second zone and a second screen assembly connected to the string assembly in the third zone.

7. The system of claim 5, wherein the first fluid pathway extends between sections of the annulus external to the first and second screen assemblies in the second and third zones respectively, and a second fluid pathway defined by the string assembly extends internally between the first and second screen assemblies.

8. The system of claim 1, wherein the seal assembly includes at least one reactive element packer.

9. The system of claim 8, further comprising a barrier for initially isolating the borehole while the at least one reactive element packer sets.

10. The system of claim 1, wherein the first zone includes shale, gas, water, or a combination including at least one of the foregoing.

11. The system of claim 1, further comprising an actuatable mechanism for selectively opening one or more ports for enabling fluid communication between the annulus and a second fluid pathway defined by the string assembly.

12. The system of claim 11, wherein the one or more ports enables fluid communication with the annulus proximate the first zone only.

13. The system of claim 12, wherein the first zone is a frac interval.

14. The system of claim 12, wherein the treatment includes cementing the second and third zones.

15. The system of claim 11, wherein the actuatable mechanism includes a seat operatively arranged to receive a plug, ball, or differential hydraulic pressure for enabling the one or more ports to be selectively opened.

16. The system of claim 11, wherein the actuatable mechanism is disposed radially between an outer string and an inner string of the string assembly.

17. The system of claim 16, wherein the one or more ports are opened by aligning sections of the one or more ports in the outer string, the inner string, and the actuatable mechanism together.

18. A method of operating a treatment system, comprising:

isolating a first zone in a borehole from a second zone and a third zone located on opposite sides of first zone; and treating the second zone and the third zone simultaneously through one of a first flow pathway fluidly connected to an annulus of the borehole, the first flow pathway formed by a string assembly extending between the second zone and the third zone and operatively arranged to bypass the first zone while enabling fluid communication between the second and third zones.

19. The method of claim 18, wherein the string assembly includes an inner string disposed within an outer string.

20. The method of claim 19, wherein the first flow pathway is defined between the inner and outer strings and a second flow pathway is interior to the inner string.

21. The method of claim 18, wherein a first screen assembly is connected to the string assembly in the second zone and a second screen assembly is connected to the string assembly in the third zone.

22. The method of claim 21, further comprising, after treating, producing through the first zone, the second zone, the third zone, or a combination including at least one of the foregoing.

23. The method of claim 18, wherein the first zone includes shale, gas, water, or a combination including at least one of the foregoing.

24. The method of claim 18, wherein treating the second and third zones simultaneously includes cementing, gravel packing, acidizing, stimulating, or a combination including at least one of the foregoing.

25. The method of claim 18, further comprising actuating a mechanism for opening one or more ports for enabling fluid communication between the annulus and a second fluid pathway defined by the string assembly.

26. The method of claim 25, wherein the one or more ports are in fluid communication with the annulus proximate the first zone only.

27. The method of claim 25, wherein actuating the mechanism includes receiving a plug on a seat of the mechanism and pressurizing against the seat and the plug.

* * * * *